US008165269B2

(12) United States Patent
Lee et al.

(10) Patent No.: US 8,165,269 B2
(45) Date of Patent: Apr. 24, 2012

(54) X-RAY TARGET WITH HIGH STRENGTH BOND

(75) Inventors: David S. K. Lee, Salt Lake City, UT (US); John E. Postman, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/239,536

(22) Filed: Sep. 26, 2008

(65) Prior Publication Data

US 2010/0080358 A1 Apr. 1, 2010

(51) Int. Cl.
*H01J 35/08* (2006.01)
*H01J 35/10* (2006.01)

(52) U.S. Cl. ..... 378/144; 378/143

(58) Field of Classification Search ..... 378/119, 378/121, 143, 144; 313/632; 315/5.38
See application file for complete search history.

(56) References Cited

U.S. PATENT DOCUMENTS

| | | | | |
|---|---|---|---|---|
| 3,819,971 | A * | 6/1974 | Kaplan et al. | 378/144 |
| 4,352,041 | A * | 9/1982 | Hubner et al. | 378/144 |
| 4,388,728 | A * | 6/1983 | Emmanuel | 378/34 |
| RE31,568 | E * | 4/1984 | Devine, Jr. | 378/125 |
| 4,618,972 | A * | 10/1986 | Georgiou et al. | 378/34 |
| 4,641,334 | A * | 2/1987 | Devine, Jr. | 378/144 |
| 4,715,055 | A * | 12/1987 | Devine, Jr. | 378/144 |
| 4,802,196 | A * | 1/1989 | Tiearney et al. | 378/143 |
| 4,972,449 | A * | 11/1990 | Upadhya et al. | 378/144 |
| 5,008,918 | A * | 4/1991 | Lee et al. | 378/144 |
| 5,099,506 | A * | 3/1992 | Van Der Kooi et al. | 378/144 |
| 5,122,422 | A * | 6/1992 | Rodhammer et al. | 428/634 |
| 5,247,563 | A * | 9/1993 | Block et al. | 378/144 |
| 5,264,801 | A * | 11/1993 | DeCou et al. | 378/129 |
| 6,215,851 | B1 * | 4/2001 | Meilunas et al. | 378/119 |
| 6,554,179 | B2 * | 4/2003 | Horner et al. | 228/122.1 |
| 2004/0234033 | A1 * | 11/2004 | Anno et al. | 378/133 |
| 2011/0236772 | A1 * | 9/2011 | Burchardt et al. | 429/403 |

FOREIGN PATENT DOCUMENTS

EP 249141 A2 * 12/1987

* cited by examiner

*Primary Examiner* — Anastasia Midkiff
(74) *Attorney, Agent, or Firm* — Maschoff Gilmore & Israelsen

(57) ABSTRACT

In one example, an x-ray target comprises a substrate, a target core, and a target track. The substrate and target core are attached together utilizing a carbide layer and a braze layer.

20 Claims, 2 Drawing Sheets

X-RAY TARGET WITH HIGH STRENGTH BOND

BACKGROUND

The present invention relates to x-ray targets. X-ray devices of all types require a cathode and an x-ray target, which serves as an anode. A voltage is connected across the cathode and the x-ray target to create a potential difference between the cathode and the x-ray target. Electrons emitted by the cathode are accelerated across the potential and collide with the x-ray target so as to produce x-rays.

The x-ray target must be able to withstand strenuous high temperature operating conditions. The x-ray generation process, generally described above, causes the x-ray target to reach operating temperatures as high as several thousand degrees Celsius. Thus, the x-ray target must be constructed from materials that can withstand x-ray system operating temperatures. X-ray targets are also designed with materials to facilitate heat conduction away from a target track.

The x-ray operating temperature requirements lead to a multiple material x-ray target design. First, a substrate is provided that is made from a material that is relatively resistant to heat conduction. Second, a target core is attached to the substrate. The target core is made from a material with high heat conductivity. Finally, a target track is attached to the target core to complete the x-ray target. The target track is made from a material that can withstand the high temperature x-ray operating conditions located at the point where electrons emitted from the cathode collide with the x-ray target.

X-ray targets of the aforementioned construction present durability problems. Specifically, x-ray targets have a tendency to fail at the bond between the target core and the substrate.

BRIEF SUMMARY OF AN EXAMPLE EMBODIMENT OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In one example embodiment, an x-ray target comprises a substrate, a target core, and a target track. The substrate and target core are attached together utilizing a carbide layer and a braze layer.

BRIEF DESCRIPTION OF THE DRAWINGS

To clarify certain aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings.

DETAILED DESCRIPTION OF SOME EXAMPLE EMBODIMENTS

Reference will now be made to the drawings to describe various aspects of some example embodiments of the invention. The drawings are only diagrammatic and schematic representations of such example embodiments and, accordingly, are not limiting of the scope of the present invention, nor are the drawings necessarily drawn to scale. Embodiments of the invention relate to x-ray devices, x-ray targets, and methods for making x-ray targets.

1. Example X-Ray Device

Figure 1:
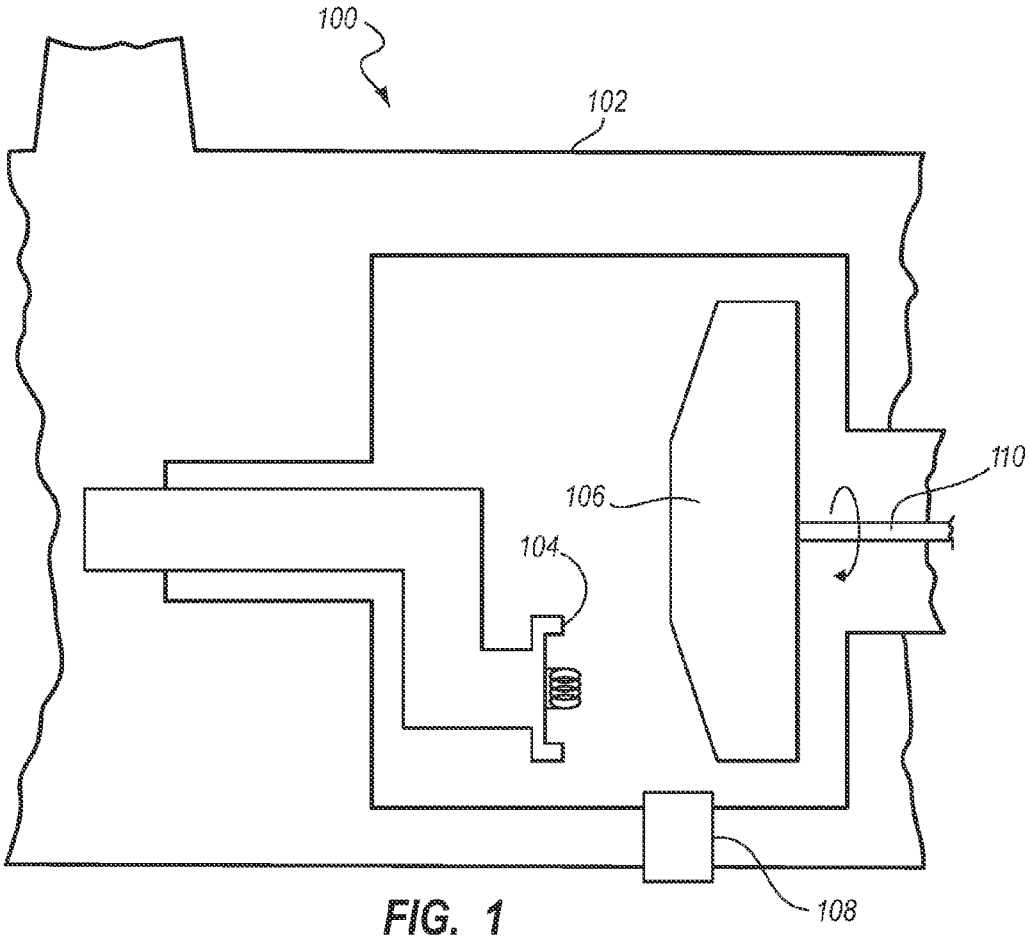
FIG. 1 is a cutaway view disclosing aspects of an example x-ray tube showing the arrangement of a cathode and an x-ray target within an x-ray tube housing.

Directing attention to FIG. 1, aspects of one example of an x-ray device 100 are disclosed. The x-ray device 100 has a housing 102 within which various components are disposed. The components within the housing 102 include a cathode 104 that is spaced apart from an x-ray target 106. A window 108 is located in the housing 102. The x-ray target 106 is connected to a shaft 110.

In operation, a voltage is applied across the cathode 104 and the x-ray target 106 to create a potential difference between the cathode 104 and the x-ray target 106. Electrons emitted by the cathode 104 are accelerated by the potential and collide with the x-ray target 106 so as to produce x-rays. The x-rays pass through the window 108 and into the x-ray subject.

A byproduct of the x-ray generation process is heat. To spread heat over a greater x-ray target area, a rotating x-ray target may be used. In a rotating x-ray target configuration, the x-ray target 106 is connected to a shaft 110. The shaft 110 is used to rotate the x-ray target 106 during the x-ray generation process. In this way, the heat that is generated is distributed throughout the x-ray target 106. In other embodiments, the x-ray target may be stationary.

The x-ray device 100 may be made in several different sizes and have varying x-ray generating power depending on the specific x-ray application. Some example x-ray devices, in connection with which embodiments of the invention may be employed, include, but are not limited to, medical x-ray devices, dental x-ray devices, industrial x-ray devices, and security and inspection x-ray devices.

2. Example X-Ray Target

Figure 2:
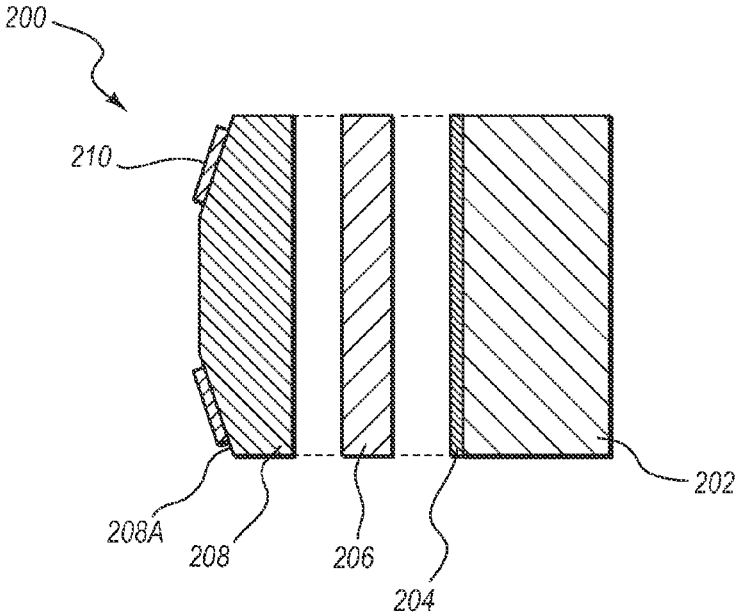
FIG. 2 is a cutaway view disclosing aspects of an example x-ray target including various possible material layers that form a bond between a target core and a substrate.

Directing attention now to FIG. 2, aspects of an example embodiment of an x-ray target 200 are disclosed. The x-ray target 200 has a substrate 202. A carbide layer 204 is attached to the substrate 202. A braze layer 206 is attached to the carbide layer 204. A target core 208 is attached to the braze layer 206. A target track 210 may be attached to the target core 208.

The example x-ray target 200 described above has a bond, between the substrate 202 and the target core 208, formed by the carbide layer 204 and the braze layer 206. As a result of this configuration, the x-ray target 200 may be relatively more reliable than an otherwise comparable x-ray target. In particular, an x-ray target that lacks, for example, the carbide layer 204, has a relatively higher interface stress between the substrate 202 and the target core 208. This stress can be caused by carbon diffusion from the substrate 202 into the braze layer 206. The carbide layer 204, in the disclosed structure, retards carbon diffusion into the braze layer 206, so as to effectively reduce the interface stress between the substrate 202 and the target core 208. The relative reduction of interface stress means that the bond between the substrate 202 and the target core 208 may be relatively stronger than the actual material of the substrate 202 or target core 208.

As suggested by the foregoing, the carbide layer 204 is one example of a structural implementation of a means for retarding carbon diffusion. The scope of the invention is not limited to this example implementation of such a means however. Rather, the scope of the invention extends to any other structure(s) that are suitable to implement the aforementioned functionality.

X-ray targets, such as x-ray target 200 for example, can be implemented in various forms. Accordingly, various characteristics of some example embodiments are discussed below.

With regard, first, to some example materials, each component of the x-ray target can comprise various materials or combinations of materials. The substrate, for example, can be made from any of a variety of different carbon bearing materials. Some examples of substrate material include graphite and graphite based composites. However, any other suitable material(s) may additionally or alternatively be employed in the construction of the substrate.

Because some embodiments of the substrate comprise carbon, at least example embodiments include a carbon management layer that may serve to retard, if not prevent, carbon diffusion out of the substrate and into one or more other layers of the target. In some embodiments, this carbon management layer takes the form of a carbide layer attached to the substrate. The carbide layer may be made from a variety of carbide-based materials. Some examples of such materials include vanadium carbide, tantalum carbide, tungsten carbide, niobium carbide, hafnium carbide, and titanium carbide. Moreover, the carbide layer does not necessarily have to be a single material. Rather, multiple carbide materials may be used to make the carbide layer. For example, the carbide layer may be a combination of vanadium carbide and titanium carbide, or a combination of any of the other disclosed carbide-based materials. The foregoing is not an exhaustive list however, and any other suitable material(s) may be employed for the carbon management layer.

In order to help secure the target core to the substrate, a braze layer may be provided on top of the carbide layer. The braze layer may be made from a variety of materials that chemically interact with the carbide layer and the target core. Some examples of braze layer materials include zirconium, platinum, and titanium. Other examples of braze layer materials include alloys of zirconium, platinum and titanium. Furthermore, a combination of one or more of zirconium, platinum and titanium, and/or a combination of their respective alloys, may be used in the braze layer. Any other suitable material(s) may likewise be employed for the braze layer.

As in the case of the other portions of the example target, the target core that is attached to the braze layer is made from materials that can withstand the high temperatures experienced during the x-ray generation process. Some examples of target core materials include Tungsten and Molybdenum alloys, examples of which are TZM, Mo—HfC, Mo—W, Mo—Re, and Mo—Nb. Furthermore, the target core may be made from Mo-Lanthana, Mo-Ceria, Mo-Yttria, Mo-Thoria, or other combinations of the alloying elements. Any other suitable material(s) may likewise be employed for the target core.

With regard, finally, to some example materials for the target track of the target core, the target track may comprise any of a variety of high Z (atomic number) materials that produce x-rays when struck by electrons. Some examples of target track materials are tungsten and tungsten-rhenium alloy, but any other suitable material(s) can likewise be employed in the construction of the target track.

Just as there are a variety of possible materials used to make the x-ray target, there is also a variety of different possible x-ray target geometries. The thickness of each example component of the x-ray target is one example of how the geometric attributes of the x-ray target may vary. Generally, FIG. 2 shows an example of the thickness of each component of the x-ray target 200 relative to other components. However, there is no requirement that the relative thickness of each component be as shown in FIG. 2. The relative thickness for each component may differ from one embodiment to another, and within a single embodiment. For example, the substrate 202, shown in FIG. 2, is relatively thicker than the target core 208. But in one alternative design, for example, if less heat capacity were required for the x-ray target, the substrate may be made thinner than the target core.

Furthermore, FIG. 2 shows an example x-ray target 200 with each component having a substantially constant thickness throughout the component layer, except for the target core 208. These example components shown with substantially constant thickness, including the substrate 202, carbide layer 204, braze layer 206, and target track 210, may alternatively have varying thickness throughout the component.

Considering the substrate and target core, the thickness of each of those components may vary depending, for example, on the requirements of the x-ray device. The substrate thickness, for example, may be determined based on heat capacity and weight requirements. In some embodiments, thickness of the substrate is a function of required heat capacity and/or weight requirements so that the more heat capacity required, the thicker the substrate, while the lower the weight requirement, the thinner the substrate. The thickness of the target core may likewise be determined based on design requirements. For example, the thickness of the target core may be based on the required x-ray power and/or application of the x-ray device.

As in the case of the target core and substrate, the respective carbide layer and braze layer thicknesses may vary from one embodiment to another, and within a single embodiment. The particular thickness employed can depend, for example, on the thickness required to create a bond between the substrate and the target core that will withstand the heat produced by the x-ray generation process. Some example thicknesses of the carbide layer range from about five microns to about fifty microns. Some example thicknesses of the braze layer range from about fifty microns to about five hundred microns. The carbide layer thickness and braze layer thickness may be thinner or thicker than the ranges described above depending, for example, on the thickness and diameters of the substrate and target core, and/or other variables.

Not only can the thickness of various x-ray target components be varied as desired, but various other geometric attributes of the x-ray target components may likewise be varied. By way of example, the respective diameters of each component may vary from one embodiment to another, and within a single embodiment. The substrate and target core may have a variety of diameters depending, for example, on the x-ray generation power requirements and/or application of the x-ray device. Some examples of outside diameters of the substrate and target core range from about one inch to about ten inches, but can be bigger or smaller depending on the x-ray generation power required and/or the application of the x-ray device where the x-ray target is used.

The diameters for each example component may vary from one embodiment to another such that any given component may have a diameter different from that of any other component. FIG. 2 illustrates one example of an x-ray target 200 where the diameters of the substrate 202, carbide layer 204, braze layer 206, and target core 208 are substantially equal. Alternatively, for example, the substrate may have a different diameter than the carbide layer, braze layer, and target core.

As a further example of the variable geometric attributes of the target components, the extent to which each component contacts or otherwise interfaces with adjacent components is another example of how the geometric configuration of the x-ray target may vary. FIG. 2 shows one example where most example components of the x-ray target 200 are substantially coextensive with the respective surfaces of one or more adjacent components. By way of contrast however, the example target track 210 extends over only a portion of the surface of the target core 208. In an alternative example, the carbide layer may cover only a portion of the surface of the substrate, while being substantially coextensive with the braze layer. In this example, the braze layer may cover only a portion of the respective surfaces of the target core and/or the target core.

As a final example of variable geometric attributes of the target components, the shape of those components may vary from one component to another. By way of example, FIG. 2 shows an example of the target track 210 that has a substantially annular configuration. The inside and outside diameters of the target track 210 may vary depending, for example, on the design of the x-ray device 100 and placement of the cathode 104. Alternatively, the target track 210 may substantially cover the upper surface 208A of the target core 208. As a further example, the substrate and the target core may each have a substantially cylindrical shape, while the carbide layer and braze layer each have a substantially annular shape.

Varying geometric attributes such as the thickness, diameter, size and shape of one or more of the example components of the x-ray target may be employed to desirably achieve a particular geometric configuration for the x-ray target. One example of an overall shape of the x-ray target 200 is shown in FIG. 2, where the x-ray target 200 has a target core 208, that is cylindrical with a trapezoidal cross section, attached to a cylindrical substrate 202. The overall shape of the x-ray target 200 may take any other suitable form as well, and the scope of the invention is not limited to past x-ray target geometry.

Geometric attributes such as the examples discussed above may also be varied as necessary to suit the particular way in which a target is employed. By way of example, some embodiments of the x-ray target may be configured to be mounted to a shaft 110 so that a rotational motion can be imparted to the x-ray target. One example design of a rotating x-ray target includes creating a circular hole in the substrate where the shaft is inserted. The shaft may be attached to the substrate in a variety of ways including, but not limited to, welding, slip tolerance fit, or through the use of mechanical fasteners such as bolts or screws. Furthermore, the hole created in the substrate may extend through any layer, or all layers of the x-ray target.

3. Example Method of Making an X-Ray Target

Figure 3:
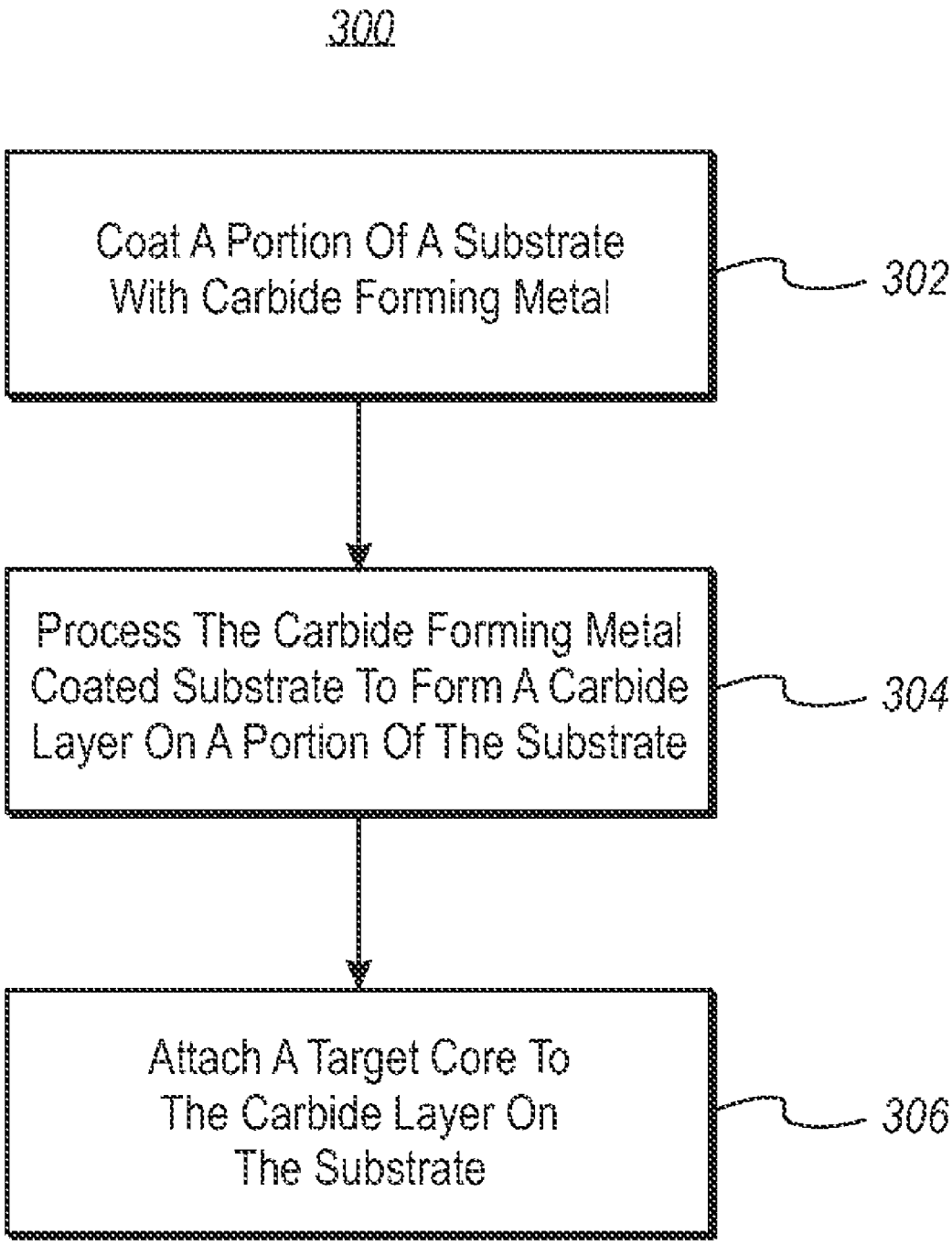
FIG. 3 is a flow diagram disclosing aspects of an example method of making a bond between the target core and the substrate.

Directing attention now to FIG. 3, aspects of a method 300 for creating a bond shown between a substrate and a target core are briefly summarized. First, some or all of a substrate surface is coated 302 with a material that forms a layer which serves or can be modified to serve, to inhibit, if not prevent, carbon diffusion from a carbon based substrate into one or more other layers of the target with which the substrate is associated. One example of a material that can be applied and subsequently processed to form a carbon diffusion inhibiting layer is a carbide forming metal. Second, the coated substrate is subsequently processed 304 such that the carbide forming metal coat forms a carbide layer on the substrate. Finally, the target core is attached to the carbide coated substrate using a braze layer or comparable structure(s) and processes. The coating 302, processing 304, and attaching 306 can each be performed using a variety of techniques, examples of which will be discussed below.

In more detail, the coating 302 of the substrate with carbide forming metal may be performed in a variety of ways. For example, a chemical vapor deposition process may be used to coat the substrate with carbide forming metal. In this example process, a metal hydride of a carbide forming metal is first deposited on the substrate. Then the metal hydride decomposes to form a carbide forming metal coat on the substrate. Other example coating methods may also be used, such as electrodeposition, electroplating, vacuum sputtering, melt evaporation, or any combination of the above processes.

There is a variety of carbide forming metals that may be used to coat the substrate. Some example carbide forming metals are vanadium, tantalum, tungsten, niobium, hafnium, and titanium. These example carbide forming metals may be used alone or in combination with one another. In one embodiment, the carbide forming metal coating deposited on the substrate is pure or substantially pure metal.

The thickness of the carbide forming metal coat may vary from one embodiment to another. One example embodiment of the carbide forming metal coat has a thickness in a range of about five to fifty microns. However, the thickness of the carbide forming metal coat may be any thickness that allows for the creation of the carbide layer from processing 304 sufficient to retard carbon diffusion from the substrate while attaching 306 the substrate to the target core. The carbide forming metal coat thickness may be deposited as a single coat or alternatively, may be formed by deposition of multiple coats of various materials on the substrate.

After being coated 302 with carbide forming metal, the substrate is processed 304. One example of processing 304 is a vacuum outgassing process. In one specific implementation of this example process, the carbide forming metal coated substrate is placed in a high vacuum furnace with a temperature greater than about 1600 degrees Celsius. The carbide forming metal coated substrate is outgassed for a period necessary for the carbide forming metal coat on the substrate to form the carbide layer. An example outgas period for the carbide forming metal coat to form the carbide layer can range from about one-half hour to about four hours for the temperature noted above. Time and temperature of the outgassing process can be varied.

As mentioned above, during the outgassing process, the carbide forming metal coat on the substrate forms a carbide layer on the substrate due to the environment created by the outgassing process. For example, if the substrate was coated with vanadium, the coated vanadium forms a layer of V2C and/or VC, and leaves little to no elemental vanadium on the substrate. The formed carbide layer retards carbon diffusion from the substrate during the attaching 306 process, which effectively reduces the interface stress between the substrate and the target core. This reduction of interface stress may produce a bond between the substrate and the target core that is relatively stronger than the actual material of the substrate or target core.

After the carbide layer is formed, the substrate with the carbide layer may be attached 306 to the target core in a variety of ways. For example, the substrate may be attached 306 to the target core by performing a braze attachment using a braze material. In one example, a braze material is secured between the carbide layer on the substrate and the target core. The braze material corresponds to the braze layer 206 as discussed above in section 2. In one specific example, the assembly is then brazed at a temperature in the range of about 1560 degrees to about 1590 degrees Celsius for roughly five to ten minutes in a vacuum furnace. Of course, other times, pressures and/or temperatures may alternatively be employed.

During brazing, the braze material becomes molten and chemically interacts with the target core and the carbide layer. The carbide layer retards carbon diffusion from the substrate to the molten braze material, which reduces the interface stress in the bond between the substrate and target core relative to if the carbide layer were not present. Some example braze materials include zirconium, titanium, platinum, or any combination of zirconium, titanium or platinum. The time and temperature of the braze run will vary depending, for example, on the braze material used.

In one example braze process, the braze material comprises a washer that is secured between the target core and substrate. In another example braze process, a hydride paste of braze material is placed between the target core and substrate. For example, zirconium hydride paste may be placed between the carbide layer on the substrate and the target core. The above brazing process, or any other suitable braze process, is then performed to secure the target core to the substrate.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of making an x-ray target, comprising:
depositing a metal hydride on a portion of a substrate having carbon;
decomposing the metal hydride with the carbon of the substrate so as to form a carbide metal, the carbide metal forming a carbide metal coating on the substrate;
processing the carbide metal coated substrate to form a carbon diffusion inhibiting layer comprising the carbide metal on a portion of the substrate; and
attaching a target core to the carbon diffusion inhibiting layer.

2. A method of making an x-ray target as recited in claim 1, wherein the depositing of the metal hydride is performed by chemical vapor deposition process.

3. A method of making an x-ray target as recited in claim 1, wherein the carbide metal coating is applied to the substrate in multiple layers.

4. A method of making an x-ray target as recited in claim 1, wherein the coating on the substrate comprises one of vanadium, tantalum, tungsten, niobium, hafnium, titanium, or a combination thereof.

5. A method as recited in claim 1, wherein the processing comprises outgassing the carbide metal coated substrate to form the carbon diffusion inhibiting layer.

6. A method as recited in claim 1, wherein attachment of the target core to the carbon diffusion inhibiting layer is performed using a braze technique.

7. A method as recited in claim 6, wherein the braze technique is performed with a braze material comprising one of zirconium, titanium, platinum, or a combination thereof.

8. A method as recited in claim 1, wherein the metal coating is substantially pure metal.

9. A method as recited in claim 1, wherein the step of decomposing the metal hydride includes reacting the metal hydride with a carbon on a surface of the substrate so as to leave substantially no elemental metal of the metal hydride on the substrate.

10. The method as recited in claim 1, comprising:
providing a vanadium hydride as the metal hydride; and
forming V2C and/or VC in the carbide metal coating.

11. The method as recited in claim 10, comprising forming the carbide metal coating to range from about 5 to 50 microns.

12. A method of making an x-ray target as recited in claim 10, wherein the depositing of the metal hydride is performed by chemical vapor deposition process.

13. A method of making an x-ray target as recited in claim 12, outgassing the carbide metal coated substrate to form the carbon diffusion inhibiting layer.

14. A method of making an x-ray target, comprising:
depositing a metal hydride on a portion of a substrate having carbon;
decomposing the metal hydride with the carbon of the substrate so as to form a carbide metal;
outgassing the carbide metal on the substrate so as to form a carbide metal coating on the substrate as a carbon diffusion inhibiting layer; and
brazing a target core to the carbon diffusion inhibiting layer.

15. A method of making an x-ray target as recited in claim 14, comprising:
depositing the metal hydride by chemical vapor deposition; and
reacting the metal hydride with a carbon on a surface of the substrate so as to leave substantially no elemental metal of the metal hydride on the substrate.

16. A method of making an x-ray target as recited in claim 15, comprising:
providing a vanadium hydride as the metal hydride; and
forming V2C and/or VC in the carbide metal coating.

17. A method of making an x-ray target, comprising:
depositing a vanadium hydride on a portion of a substrate having carbon;
decomposing the vanadium hydride with the carbon of the substrate so as to form a vanadium carbide;
outgassing the vanadium carbide on the substrate so as to form a vanadium carbide coating on the substrate as a carbon diffusion inhibiting layer; and
brazing a target core to the carbon diffusion inhibiting layer.

18. A method of making an x-ray target as recited in claim 17, comprising:
depositing the vanadium hydride by chemical vapor deposition; and
reacting the vanadium hydride with a carbon on a surface of the substrate so as to leave substantially no elemental metal of the vanadium hydride on the substrate.

19. A method of making an x-ray target as recited in claim 17, comprising:
forming V2C and/or VC in the vanadium carbide coating.

20. A method of making an x-ray target as recited in claim 19, comprising:
depositing the vanadium hydride by chemical vapor deposition, wherein the vanadium hydride is substantially pure vanadium hydride; and
reacting the vanadium hydride with a carbon on a surface of the substrate so as to leave substantially no elemental metal of the vanadium hydride on the substrate;
coating all of a surface of the substrate with the vanadium carbide coating being from 5 to 50 microns;
brazing the target core to the carbon diffusion inhibiting layer such that the braze material becomes molten and chemically interacts with the vanadium carbide coating, the braze material including hydride paste or a braze washer.

* * * * *